US006220658B1

(12) United States Patent
Lukawski et al.

(10) Patent No.: US 6,220,658 B1
(45) Date of Patent: Apr. 24, 2001

(54) RETRACTABLE TRAY TABLE

(75) Inventors: Traci J. Lukawski, Holland; Jeffrey L. Barber, Zeeland; Randy G. Eschelbach, Canton; James A. Dykla, Livonia, all of MI (US)

(73) Assignee: Johnson Controls Technology Company, Plymouth, MI (US)

( * ) Notice: Subject to any disclaimer, the term of this patent is extended or adjusted under 35 U.S.C. 154(b) by 0 days.

(21) Appl. No.: 09/419,141

(22) Filed: Oct. 15, 1999

Related U.S. Application Data

(60) Provisional application No. 60/104,524, filed on Oct. 16, 1998.

(51) Int. Cl.[7] ..... A47B 83/02; A47C 7/70

(52) U.S. Cl. ..... 297/145; 297/173; 297/188.16

(58) Field of Search ..... 297/144, 145, 297/155, 173, 188.16, 188.17

(56) References Cited

U.S. PATENT DOCUMENTS 4,372,604 * 2/1983 Raksanyi et al. ..... 297/145 X
5,035,464 * 7/1991 Spallholtz ..... 297/144
5,087,096 * 2/1992 Yamazaki ..... 297/145
5,129,702 * 7/1992 Ervin ..... 297/144
5,547,247 * 8/1996 Dixon ..... 297/145
5,653,499 * 8/1997 Goodall ..... 297/173

FOREIGN PATENT DOCUMENTS

177232 * 6/1953 (AU) ..... 297/173
1600744 * 10/1981 (GB) ..... 297/145

* cited by examiner

*Primary Examiner*—Peter R. Crown
(74) *Attorney, Agent, or Firm*—Foley & Lardner

(57) ABSTRACT

A retractable tray table for use with a seat having an armrest on one side thereof includes a tray table connected to the armrest by a support arm and moveable to a first position and a second position. A pivot assembly mounts the tray table to the support arm. The tray table is rotatable about a first axis parallel to the support arm and a second axis perpendicular to the support arm to move the tray table from the first position to the second position. A locking mechanism cooperating with the support arm releasably secures the tray table in the first position and the second position.

10 Claims, 11 Drawing Sheets

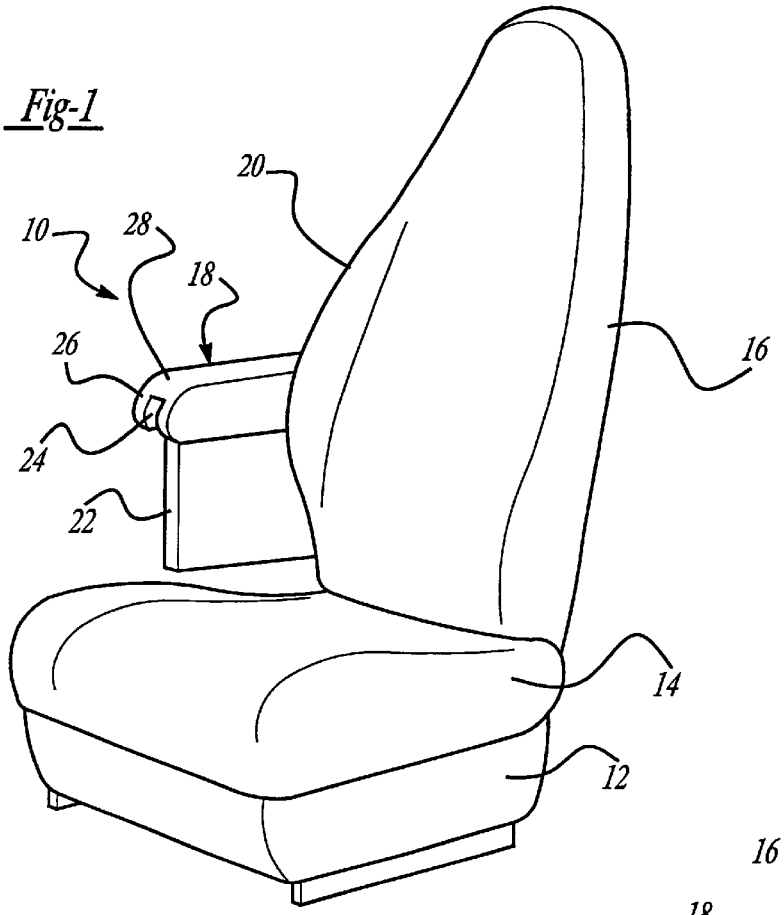
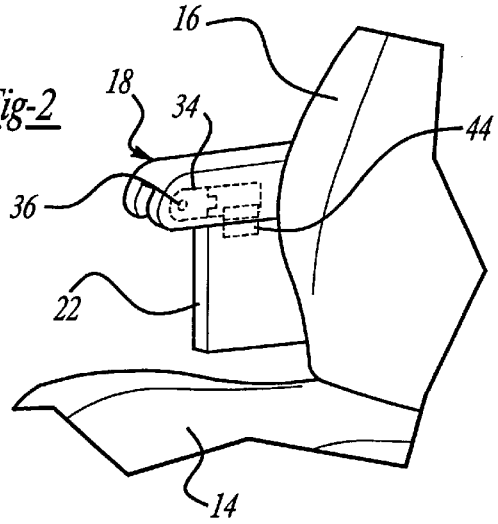
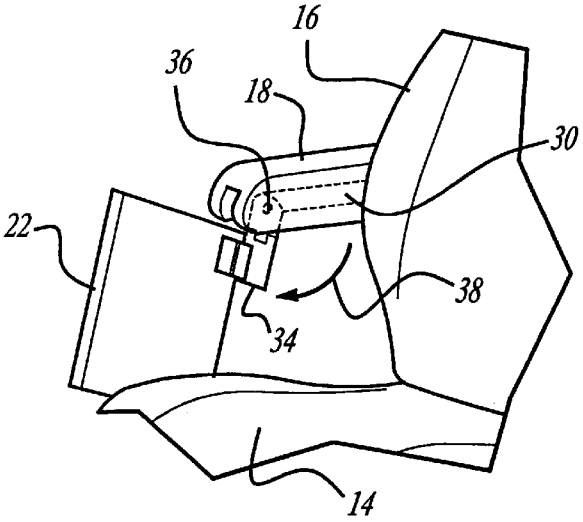
Fig-3

RETRACTABLE TRAY TABLE

CLAIM OF PRIORITY

This application claims priority to U.S. provisional application No. 60/104,524, filed Oct. 16, 1998, and which is incorporated herein by reference.

TECHNICAL FIELD OF THE INVENTION

This invention generally relates to tray tables for a vehicle seat. More specifically, this invention relates to a tray table for a vehicle seat movable between a retracted or stowed position and an extended or use position.

BACKGROUND

It is known in the art to stow a tray table adjacent a seat, usually under one of the armrests. The tray table is typically movable to one or more positions, such as a stowed position and a use position. Prior tray table designs, however, typically suffer from unreliable rotation and locking mechanisms. For ease of use, it is paramount to provide a tray table moveable from stowed and use positions through simple and reliable rotating and locking mechanisms.

SUMMARY OF THE INVENTION

The tray table assemblies according to the invention are simple and reliable. First, a cam and follower locking mechanism allows the pivot arm to rotate upon an axis and lock in one or more positions, such as a stowed position and a use position. The pivot arm locks into position upon rotation of the arm to that position. A locking mechanism is released by continued rotation of the pivot arm in the same direction, beyond the locked position. Release of the locking mechanism allows the pivot arm to rotate in the opposite direction, to the other locked position.

Second, a telescoping pivot assembly allows a support arm to translate along and rotate about the horizontal axis and lock in one or more positions, such as a stowed position and a use position. The support arm locks into the stowed and use positions upon rotation of the arm to one of the positions. The locking mechanism is released by depressing an actuator button, which permits the support arm to translate and rotate to the other position.

BRIEF DESCRIPTION OF THE DRAWINGS

The various advantages of the present invention will become apparent to those skilled in the art after reading the following specification and by reference to the drawings in which:

FIG. 1 is a perspective view of a vehicle seat assembly containing the cam and follower locking mechanism of the present invention in conjunction with a tray table shown in the stowed position;

FIG. 2 is a fragmentary perspective view of the armrest and tray table assembly of the seat shown in FIG. 1 with the tray table shown in the stowed position;

FIG. 3 is a fragmentary perspective view similar to FIG. 2 showing the tray table in an intermediate position between the use and stowed positions;

DETAILED DESCRIPTION OF THE PREFERRED EMBODIMENTS

Figure 4:
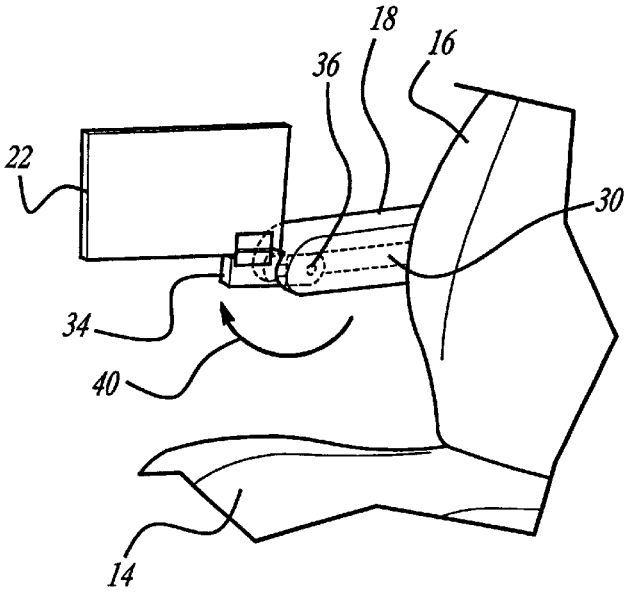
FIG. 4 is a perspective view like FIG. 3 showing the tray table in the process of being deployed with the tray table pivot arm in the use position.

A retractable tray table of the present invention is contained within the seat assembly 10 shown in FIG. 1. A seat assembly 10 is a captain's chair for a motor vehicle including a pedestal 12, a generally horizontal seat bottom 14 and a seat back 16 extending upwardly from the rear end of the seat bottom 14. The seat assembly 10 includes an armrest 18 extending generally horizontally and forward from the seat back 16 along the right side edge 20 of the seat back. The left side armrest is not shown for clarity. The left side armrest, if on the outboard side of the seat, may be incorporated into a door panel or mounted to the seat back 16. While not shown, the armrest 18 could alternatively be used on the left side of the seat back 16. In the embodiment shown, the armrest 18 is fixed in position relative to the seat back and is not rotatable from its generally horizontal, forwardly extending position shown in FIG. 1. The invention, however, is not limited to a fixed position armrest.

Figure 5:
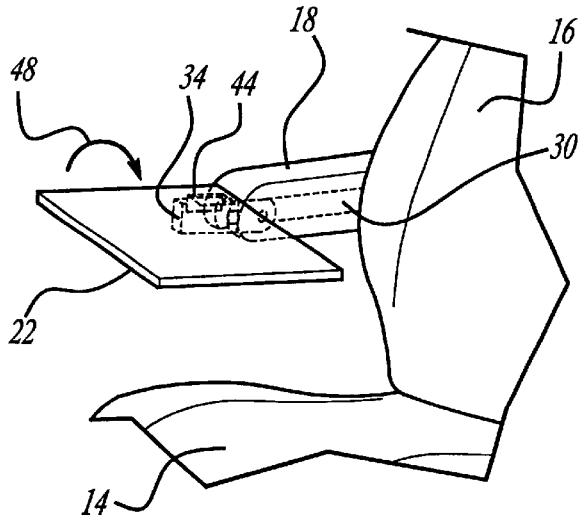
FIG. 5 is a fragmentary perspective view like FIG. 4 with the pivot arm in the use position and the tray table rotated 90° relative to the pivot arm to a tray table use position.
Figure 6:
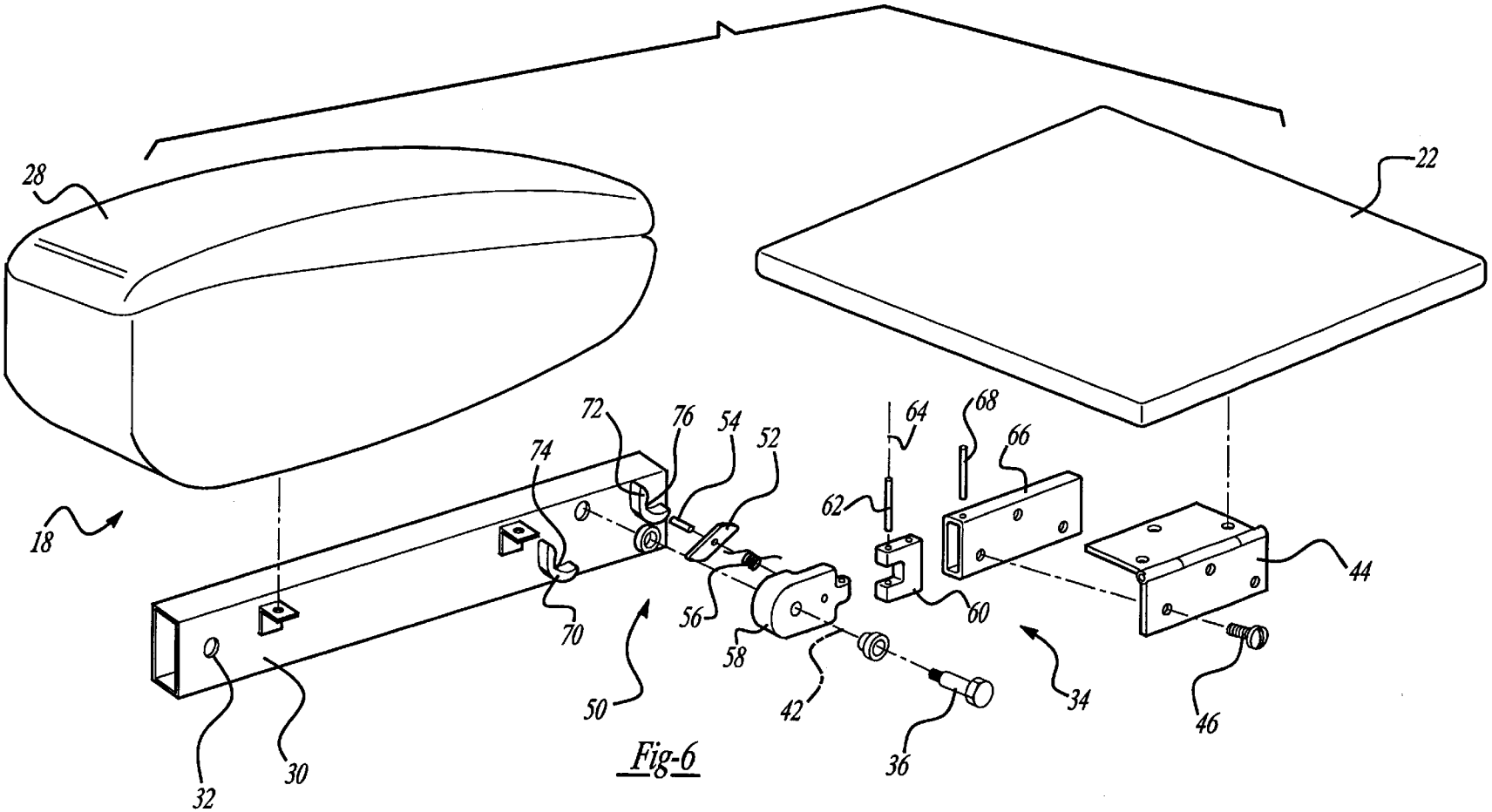
FIG. 6 is an exploded perspective view of the armrest, tray table and pivot arm together with the cam and follower locking mechanism of the present invention.

A tray table 22 is mounted to the armrest 18 through a pivot assembly including a pivot arm 34 and a hinge 44, and hangs downwardly from the armrest in a stowed position as shown in FIGS. 1 and 2. The body 28 of the armrest 18 has a channel 24 that is open from the bottom of the armrest 18 and is visible at the front end 26 of the armrest 18. As shown in FIG. 6, the armrest body 28 is coupled to a support arm 30, which is secured to the seat back with a fastener (not shown) extending through an aperture 32 in the support arm 30. The pivot arm 34 is attached to a forward portion of the support arm 30 for rotation about a pivot 36 from a stowed position within the channel 24 of the armrest body 28 to a use position extending forward from the armrest 18. The movement of the tray table 22 to its use position is illustrated by the arrow 38 in FIG. 3 and the arrow 40 in FIG. 4. The pivot 36 defines an axis of rotation 42 for the pivot arm 34 that is perpendicular to the support arm 30, as shown in FIG. 6. The pivot arm 34 rotates about the axis 42 as the pivot arm 34 is moved between the stowed position shown in FIG. 2 and the use position shown in FIG. 5.

With reference to FIGS. 2–5, the tray table 22 is connected to the pivot arm 34 by the hinge 44, which is attached to the pivot arm 34 and tray table 22 by fasteners, such as screws 46, as best shown in FIG. 6. The hinge 44 enables the tray table 22 to rotate from a generally vertical position, parallel with the pivot arm 34 and armrest 18, to a horizontal position shown in FIG. 5 in which the tray table 22 extends laterally and overlies a portion of the seat bottom 14. Rotation of the tray table 22 about an axis parallel to support arm 30 is shown by the arrow 48 in FIG. 5.

Figure 7:
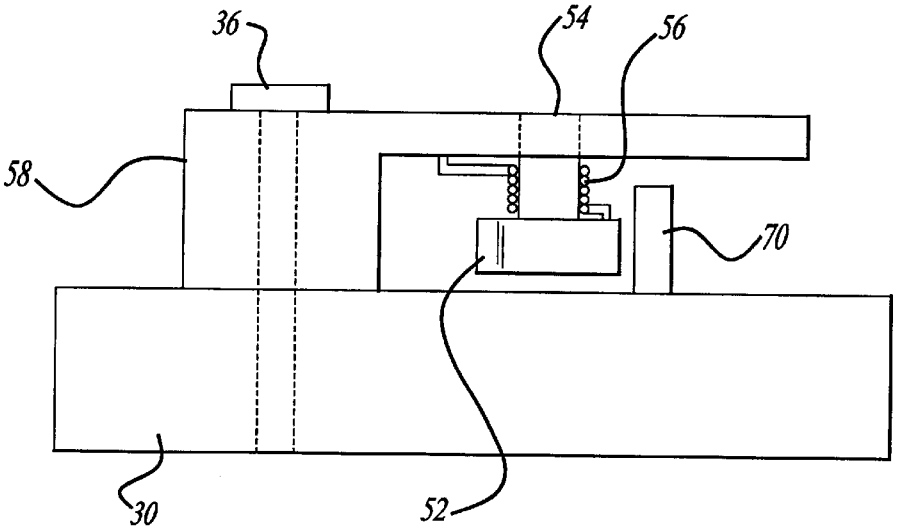
FIG. 7 is a plan view of the cam and follower locking mechanism of the present invention.

With reference to FIGS. 6 and 7, a cam and follower locking mechanism 50 is illustrated. The pivot arm 34 includes a pivot block 58 through which the pivot 36 extends to rotatably mount the pivot block 58 to the support arm 30. A breakaway arm 60 is coupled to the pivot block by a pin 62 which enables the breakaway arm 60 to rotate about the axis 64 defined by the pin 62. When the pivot arm 34 is in the use position, the axis 64 will be generally vertical, thereby allowing the breakaway arm 60 to rotate laterally away from the seat bottom 14 and seat back 16. The breakaway arm 60 is coupled to an extension tube 66 by a pin 68. The hinge 44 is coupled to the extension tube 66 to mount the tray table 22 to the pivot arm 34. The breakaway arm 60 and the extension tube 66 can be made of a single piece if desired.

The locking mechanism 50 includes a follower 52 that is rotatably mounted to the pivot arm 34 by a pivot 54. The follower 52 is rotationally biased about the pivot 54 by a spring 56. The follower 52 is coupled to the pivot block 58 of the pivot arm 34. The cams 70, 72 extend laterally from the support arm 30 and form locking cam locking surfaces 74, 76, respectively. The follower 52 engages the locking surfaces 74, 76 to hold the pivot arm 34 in the stowed and use positions, respectively.

The motion of the follower 52 during various phases of operation of the locking mechanism 50 is shown in FIGS. 8–12. The follower 52 is symmetrical in its configuration having a radial inner end 78 and a radial outer end 80. The radial outer end 80 engages the cam locking surface 74 of the cam 70 to hold the pivot arm in its stowed position. The locking surface 74 has a concave bight 82 (FIG. 10) which receives the outer end 80 of the follower 52 in the stowed position to lock the pivot arm 34 in place. The outer end 80 of the follower 52 is disposed in the concave bight 82 of the cam 70 as shown in the solid line position of FIG. 8.

Figure 8:
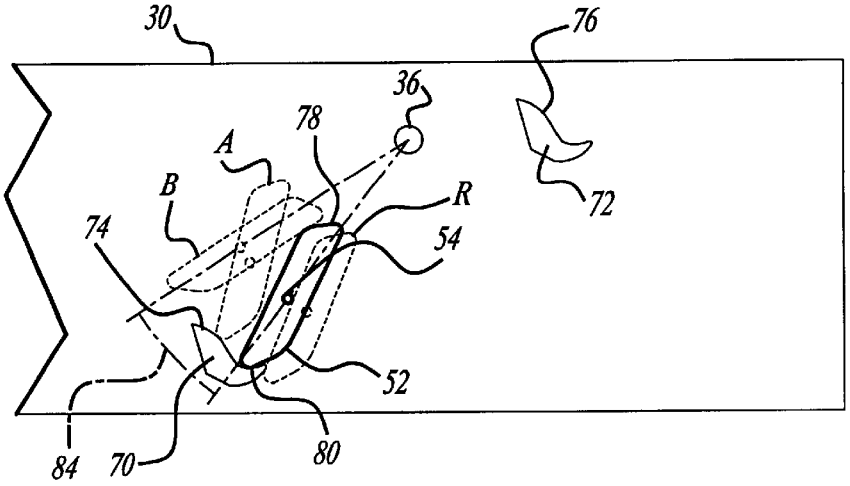
FIGS. 8–12 are side views illustrating the motion of the follower of the locking mechanism and its interaction with the cam surfaces to lock and release the pivot arm in the stowed and use positions.
Figure 9:
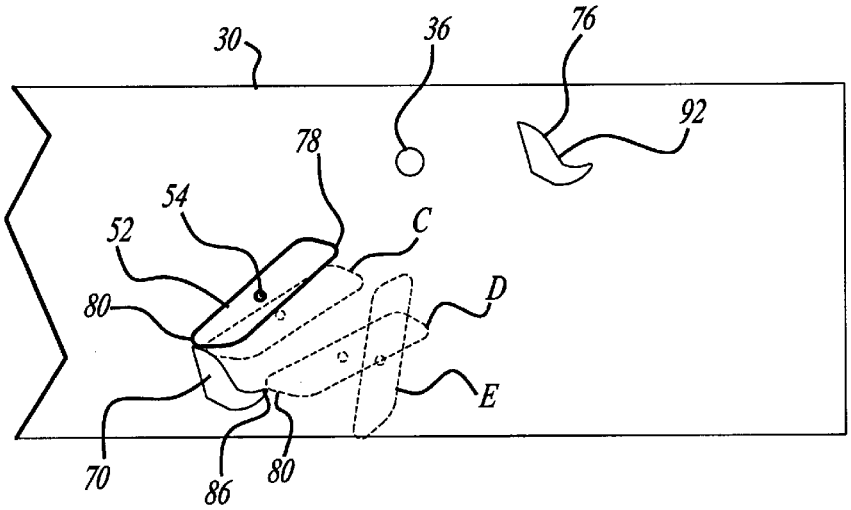

The pivot arm 34 is released from the locked, stowed position by rotating the pivot arm 34 clockwise, as viewed in FIG. 8, through the arc 84. As the pivot arm 34 is rotated through the arc 84, the cam locking surface 74 will cause the follower to rotate about the pivot 54. An intermediate position of the follower 52 is shown as position A in FIG. 8. Once the outer end 80 of the follower 52 clears the cam locking surface 74, the follower 52 will rotate to the position B under the force of the bias spring 56. In the position B, the spring 56 is in a free or unstressed position in which it does not act upon the follower 52. Rotation of the follower 52 in either direction about the pivot 54 will result in the stressing of the spring 56 and a resulting bias force acting on the follower 52. In the particular embodiment shown, when the follower 52 is in the unstressed position of the spring 56, the follower 52 is oriented generally radially relative to the pivot 36. This radial orientation of the follower 52 in the unstressed position of the spring 56 is not essential to the invention but it is helpful in describing the motion of the follower 52.

Once the pivot arm 34 has been rotated through the arc 84, the pivot arm 34 is free to rotate in the counterclockwise direction. After this counterclockwise rotation of the pivot arm 34 begins, the outer end 80 of the follower 52 will again contact the surface 74 of the cam 70. This contact is shown in the solid line position of the follower 52 in FIG. 9. Continued counterclockwise rotation of the pivot arm 34 causes the follower 52 to rotate about its pivot 54 first to the position C shown in FIG. 9, and then to the position D in which the outer end 80 clears the tip 86 of the cam 70. Once the pivot arm 34 rotates beyond the position D, the follower 52 is then rotated about the pivot 54 to the unstressed position of the spring 56, shown as position E, in which the follower 52 is oriented generally radially relative to the axis 42.

Figure 10:
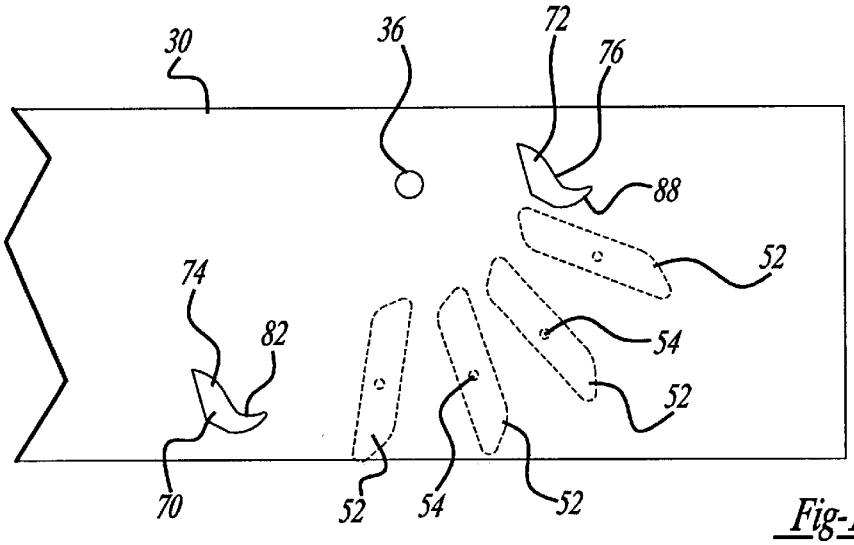

With reference to FIG. 10, the follower is shown in various positions as the pivot arm 34 continues to rotate counterclockwise about the pivot 36 to the use position of the pivot arm 34. The follower 52 remains in the radially oriented position as the pivot arm 34 rotates.

Figure 11:
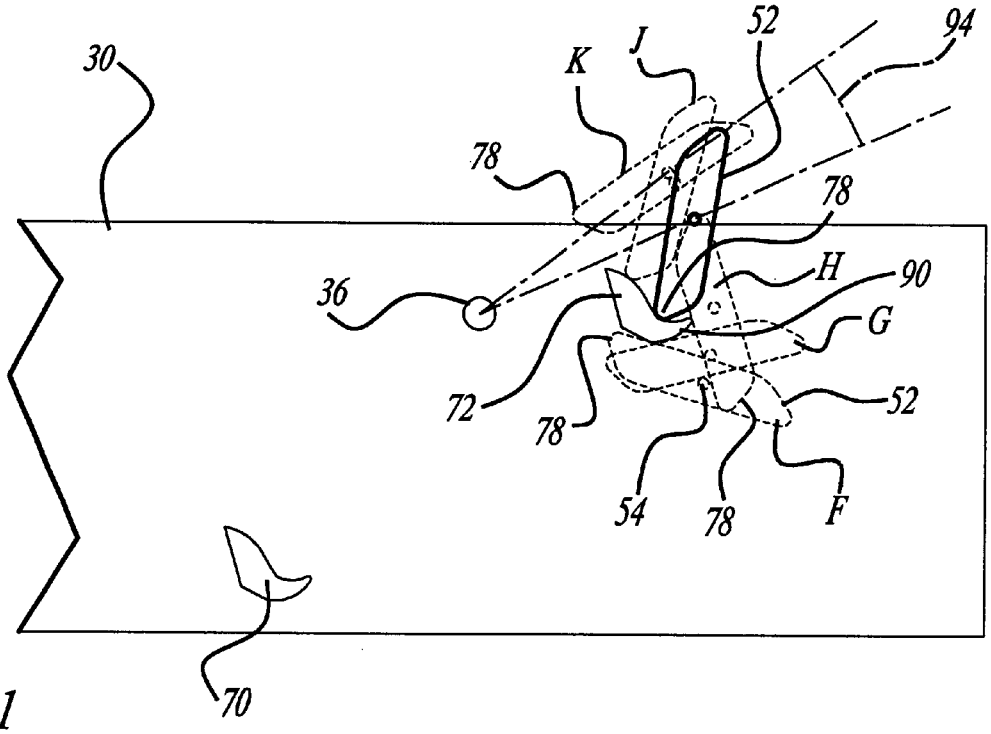

With reference to FIG. 11, the follower 52 is shown in a position F in which the follower 52 contacts the lower surface 88 of the cam 72, opposite the cam locking surface 76. Continued rotation of the pivot arm 34 causes the follower 52 to rotate counterclockwise about the pivot 54 to the position G, then to the position H, and ultimately to the solid line position where the radially inner end 78 of the follower 52 clears the tip 90 of the cam 72. Here, the radially inner end 78 seats into the concave bight 92 (FIG. 9) of the cam locking surface 76. In this position of the follower 52, the pivot arm 34 is locked in the use position and cannot be rotated clockwise from this position without first releasing the locking mechanism 50.

Figure 12:
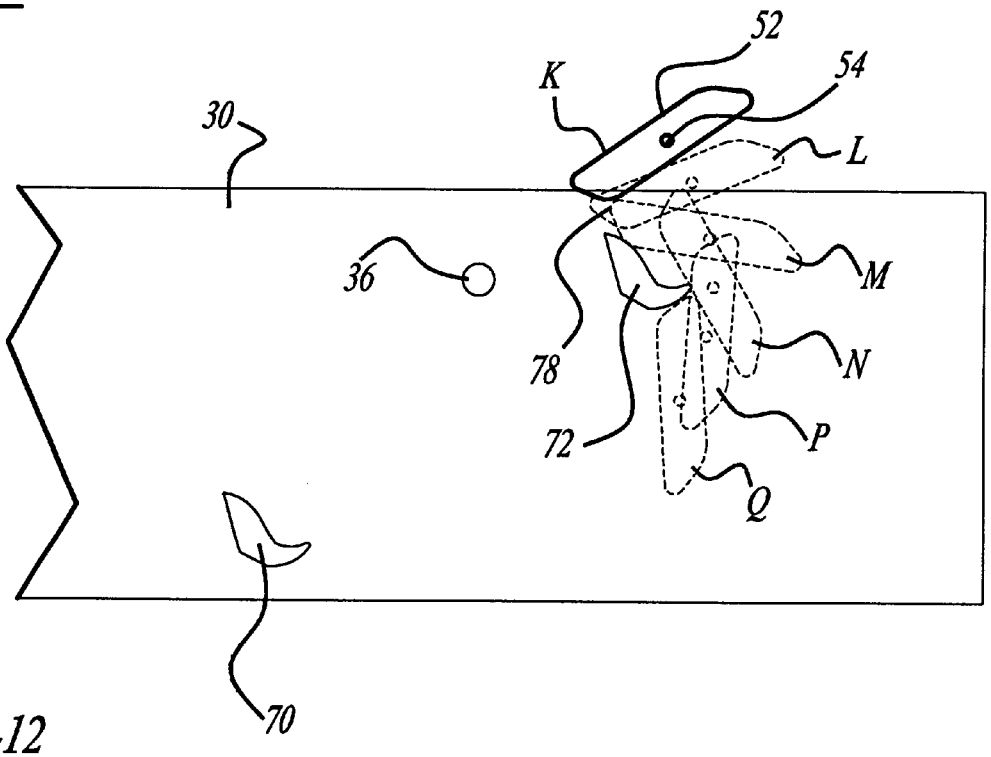

Release of the locking mechanism 50 is accomplished by continued counterclockwise rotation of the pivot arm 34 through the arc 94, which requires that the follower 52 rotate through the position J until the inner end 78 clears the cam 72 enabling the follower 52 to rotate to position K by the force of the spring 56. This movement releases the locking mechanism 50, allowing the pivot arm 34 to again be rotated clockwise to the stowed position. This motion is shown in FIG. 12 with the follower 52 shown in the solid line position designated as K. The clockwise rotation of the pivot arm 34 results in the follower 52 first moving to the position L, and then to the position M as the inner end 78 once again engages the cam 72. As the pivot arm 34 continues to rotate clockwise, the follower 52 moves through the positions N, P, and Q shown in FIG. 12. After the pivot arm 34 moves the follower 52 past the position Q in FIG. 12, the spring 56 will rotate the follower 52 to the spring unstressed position oriented generally radially from the pivot 36. The follower 52 will stay in this position until the pivot arm 34 nears the stowed position and the follower contacts the cam 70 as shown in position R of FIG. 8. Continued rotation of the pivot arm 34 causes the follower 52 to rotate counterclockwise about the pivot 54 until the radially outer end 80 seats into the concave bight 82 in the cam 70.

The locking mechanism 50 is a simple mechanism having one moving part, the follower 52, which engages different cams to hold the pivot arm 34 in either the stowed or use positions. As illustrated in the drawings, the pivot arm 34 is used to carry a tray table 22. A rotating pivot arm 34 held in place by a lock mechanism 50 could be used for other purposes. For instance, the locking mechanism 50 could be used for a rotating armrest that is attached to a seat back armrest to rotate between a use position and a stowed position. Furthermore, the locking mechanism 50 is not limited to use with a seat back mounted device.

The pivot arm 34 and the support arm 30 will typically be made of steel or other metals. However, other materials including plastic materials may be used if they provide sufficient strength for the application. The follower 52 and cams 70, 72 can also be made of a variety of different materials including metals or plastics. In a preferred embodiment, the cams 70, 72 and follower 52 are made of metal to provide a noticeable noise such as a clicking sound when the follower engages the cam in the locked position. The presence of a noticeable sound as the follower engages the cams in the locked positions avoids unintended overtravel of the pivot arm beyond its locked positions to inadvertently release the locking mechanism.

Figure 13:
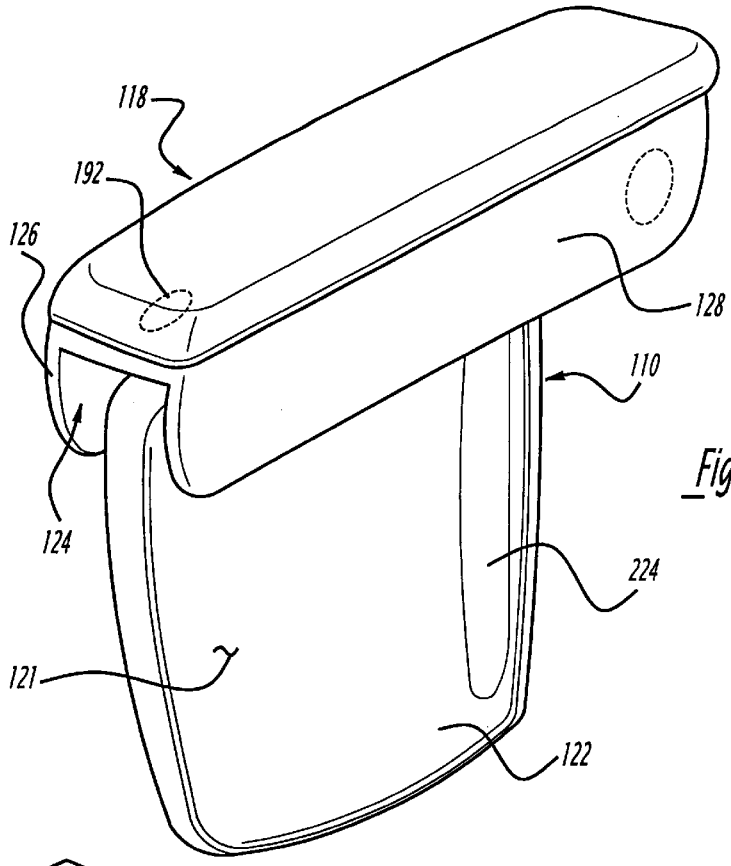
FIG. 13 is a perspective view of an armrest and tray table assembly according to a second embodiment of the invention with the tray table shown in the stowed position.

Another embodiment of a tray table according to the invention is shown in FIGS. 13–23. With particular reference to FIG. 13, a tray table assembly 110 is mounted to a single armrest 118 extending generally horizontally and forward from a seat back (not shown), such as for a seat in a motor vehicle. A body 128 of armrest 118 has an open channel 124 that is open from the bottom of the armrest 118 and is visible at a front end 126 of the armrest 118. The armrest 118 can be disposed on either side of a seat assembly as one of skill in the art will readily recognize. The single armrest 118, if on the outboard side of the seat, may alternatively be incorporated into a door panel. Further, a single armrest 118 may be fixed relative to the seat back or rotatable from its generally horizontal and forwardly extending position shown in FIG. 13.

Figure 14:
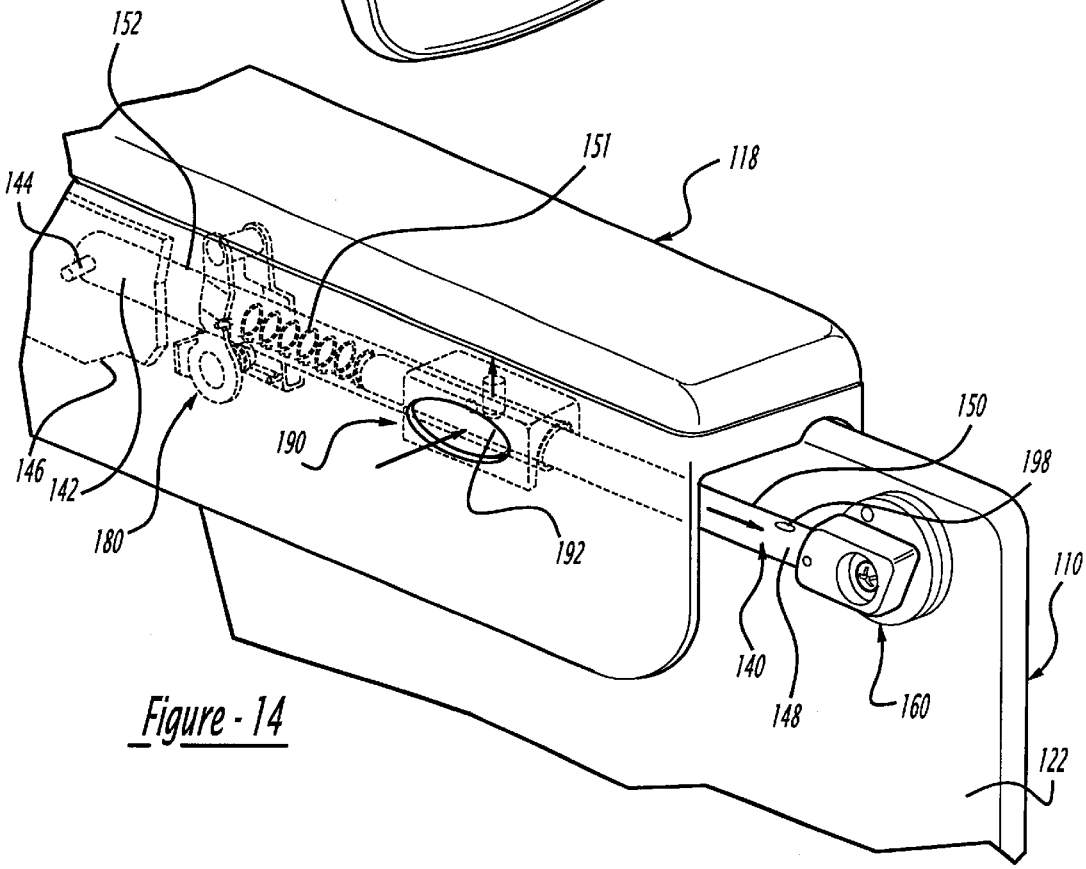
FIG. 14 is a fragmentary perspective view of the armrest and tray table assembly of FIG. 13 with the tray table in an intermediate position between use and stowed positions.
Figure 15:
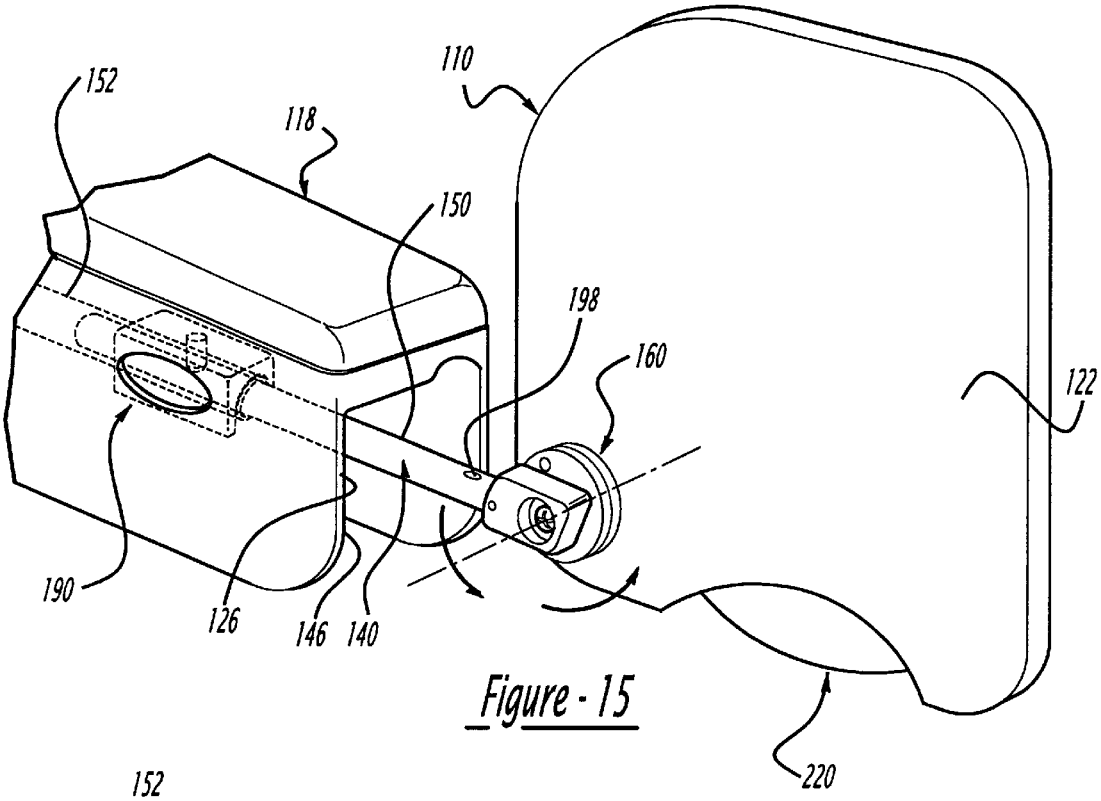
FIG. 15 is a fragmentary perspective view similar to FIG. 14 showing the tray table in yet another intermediate position between the use and stowed positions.
Figure 16:
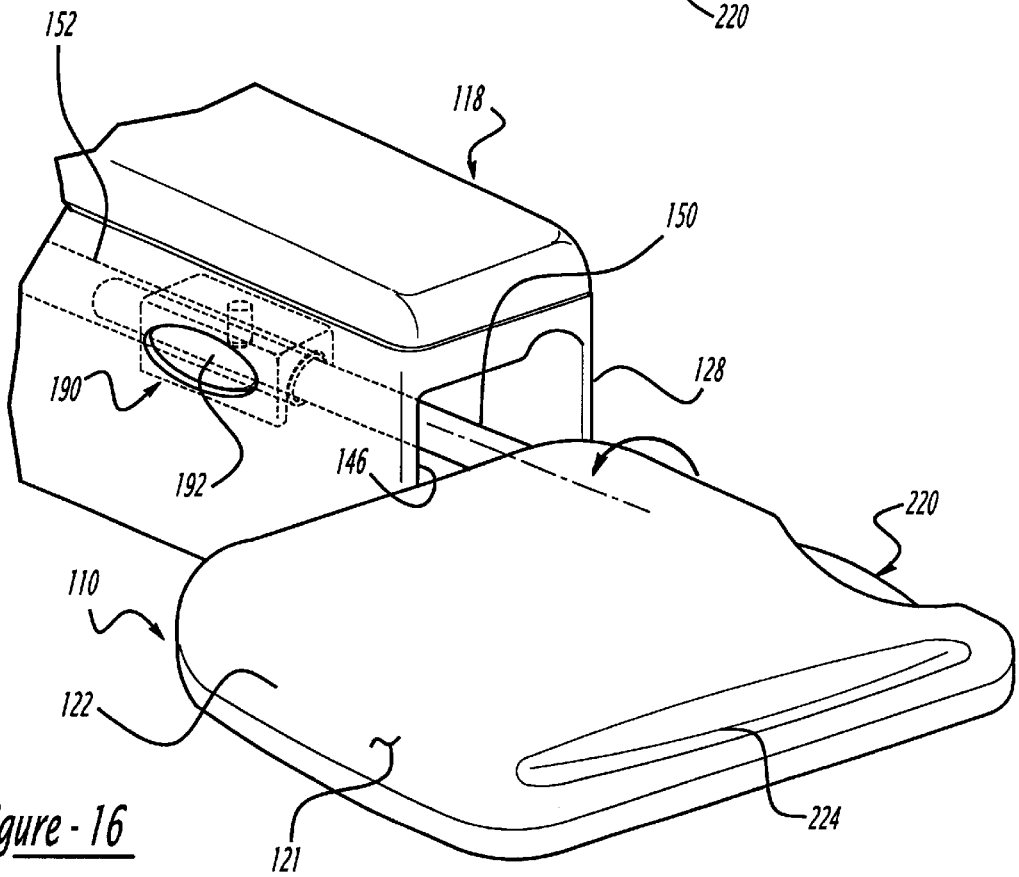
FIG. 16 is a fragmentary perspective view of the armrest and tray table assembly of FIGS. 13–15 with the tray table in the use position.

The tray table assembly 110 is mounted to the armrest 118 and extends downwardly from the armrest 118 in a stowed position, as shown in FIG. 13. The tray table assembly 110 is moveable to both a stowed position, as shown in FIG. 13, and a use position, as shown in FIG. 16, through the intermediate positions illustrated in FIGS. 14 and 15. A locking mechanism 190 releasably secures the tray table assembly 110 in both the stowed and use positions. With further reference to FIG. 14, the tray table assembly 110 includes a telescoping support arm 140 connecting a tray table 122 to the armrest 118 through a pivot assembly 160. More specifically, the telescoping support arm 140 is pivotally connected at a proximate fixed end 142 to a pivot axle 144 mounted between walls 146. The telescoping support arm 140 includes a smaller diameter tube 150 axially slidable in a larger diameter tube 152. The smaller diameter tube 150 mounts pivot assembly 160 on its exposed moveable end 148, while its opposite end is received within a bore of the larger diameter tube 152, which at fixed end 142 is connected to armrest 118 by the pivot axle 144. A spring 151 mounted within larger diameter tube 152 biases smaller diameter tube 150 axially extended, which assists in deploying the tray table 122 for use. At the moveable end 148 of telescoping support arm 140, the pivot assembly 160 supports the tray table 122. Also, the telescoping support arm 140 is intermediately supported by a releasable support assembly 180.

Figure 17:
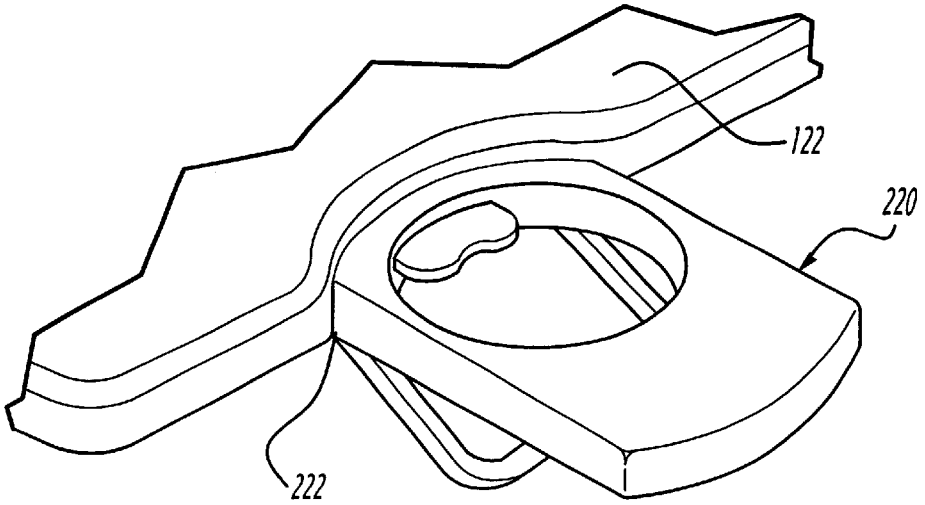
FIG. 17 is a fragmentary view of the tray table of FIGS. 13–16 with a container holder shown in the deployed position.

As shown in FIG. 17, the tray table 122 includes a pocket 222 for releasably storing a container holder 220. The container holder 220 is selectively deployed by the user for holding a beverage container, such as a cup, bottle, or can. Further, the tray table 122 preferably includes a shallow recess 224 on its top surface 121. The recess 224 is useful for holding utensils, writing instruments, or other small articles for use by the occupant.

Figure 18:
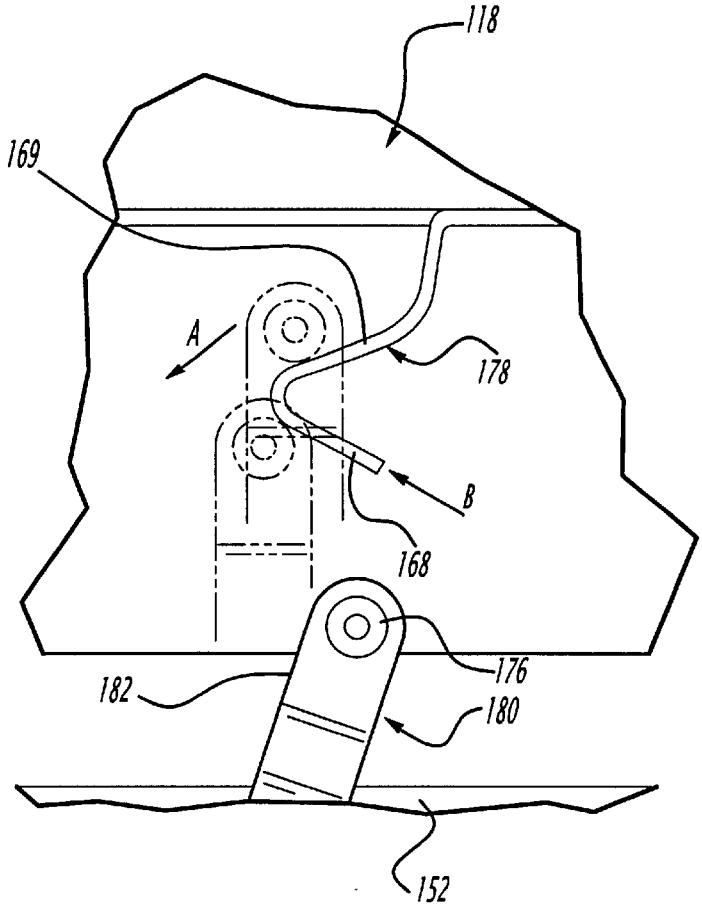
FIG. 18 is a partial side view of a safety release for the tray table of FIGS. 13–16.
Figure 19:
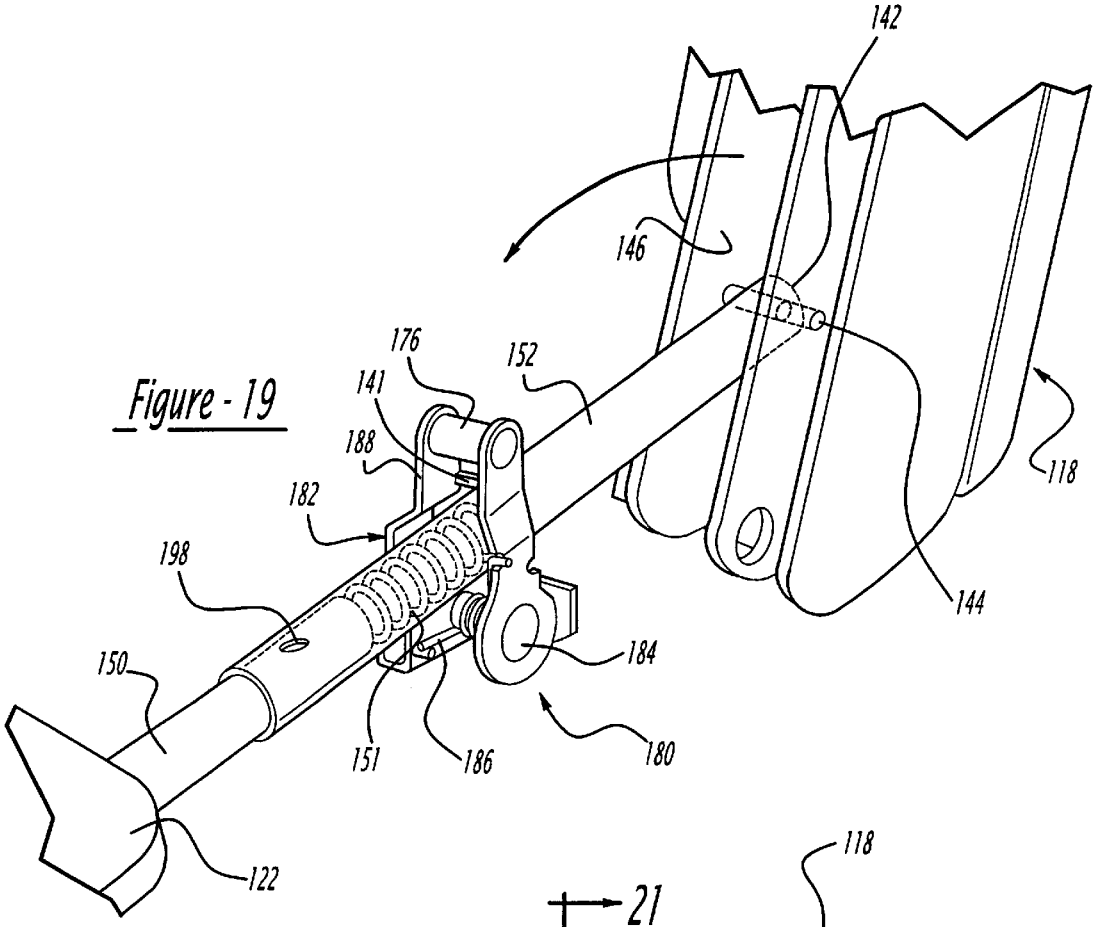
FIG. 19 is a perspective view of the tray table of FIGS. 13–16 in a released position.
Figure 20:
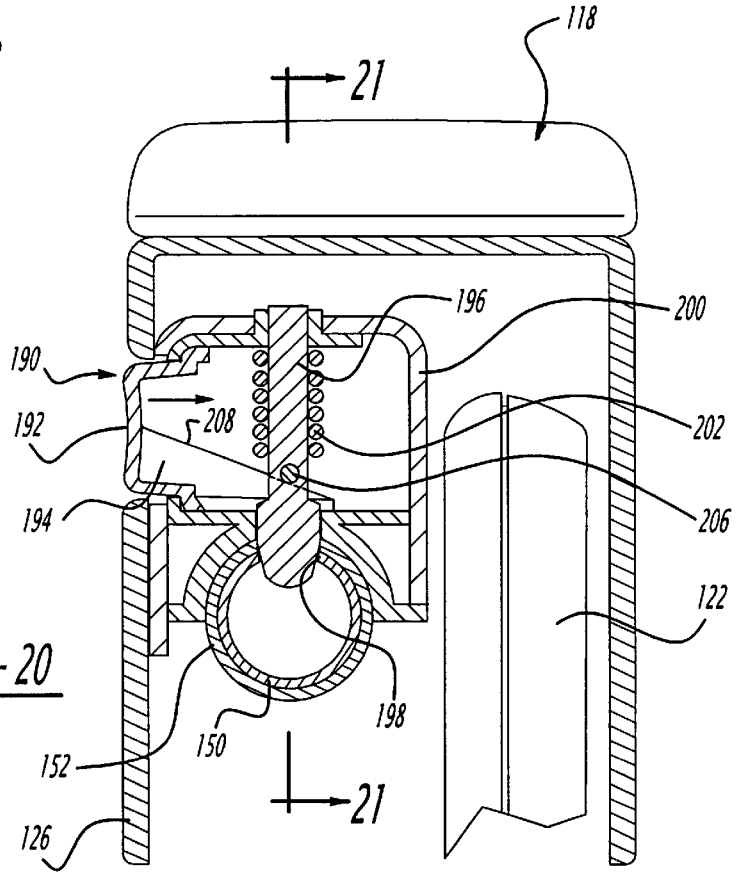
FIG. 20 is a sectional view of a locking mechanism for the tray table of FIGS. 13–16.
Figure 21:
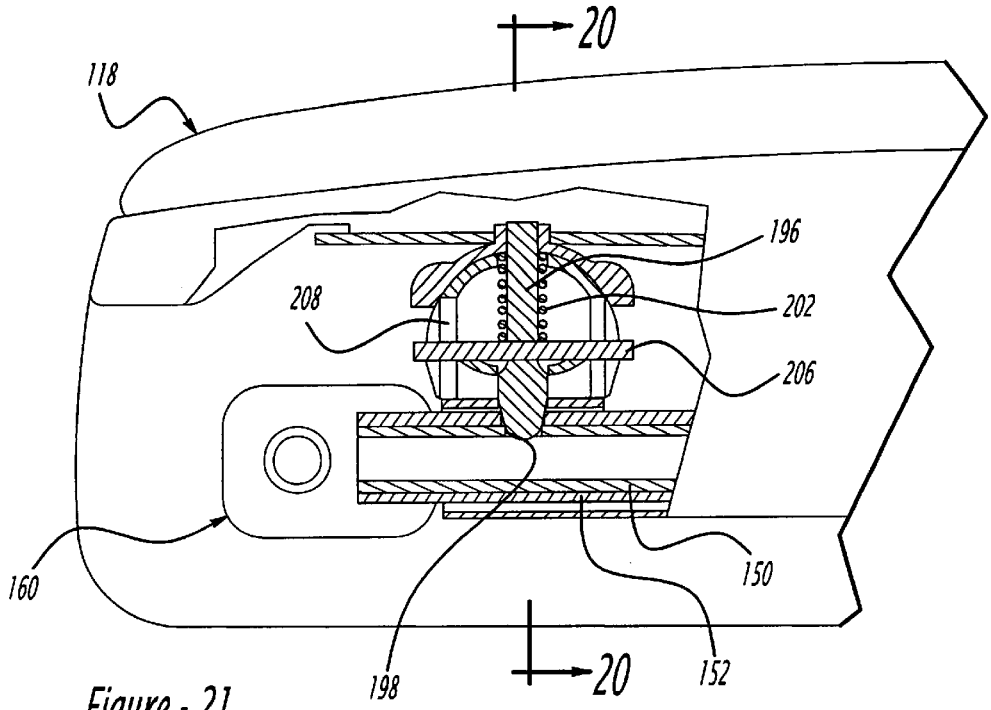
FIG. 21 is a partial sectional view of the locking mechanism of FIG. 20.

With reference to FIGS. 18 and 19, the releasable support assembly 180 is used for releasing the telescoping support arm 140 from the armrest 118 when excessive downward force has been placed on the tray table 122, particularly when it is in the use position. When the releasable support assembly 180 is released, telescoping support arm 140 pivots via pivot axle 144 at fixed end 142. The releasable support assembly 180 prevents damage to the telescoping support arm 140 when excessive weight, preferably in excess of 30 pounds, has been placed on the tray table 122.

More particularly, releasable support assembly 180 includes a pivoting latch 182 mounted on an axle 184 and biased in a generally upright position by a spring 186 mounted coaxially on the axle 184. The latch 182 includes a pair of arms 188 extending generally vertically upward from the axle 184 on opposite sides of the telescoping support arm 140, joined intermediately by an offset stop bar 141, and connected at distal ends of the arms 188 by a cylindrical catch 176. The catch 176 releasably engages a finger 178 extending into open channel 124 and supported by the armrest 118. At a proximate end of the arms 188 the latch 182 pivots on the axle 184, which is disposed subjacent support arm 140. The spring 186 mounted coaxially on the axle 184 biases the latch 182 into the generally upright position with catch 176 normally disposed behind finger 178. The latch 182 pivots when a certain amount of downward force is exerted on the tray table 122, whereupon catch 176 slides along surface 164 in the direction of arrow A of FIG. 18 until latch 182 is disengaged from finger 178. Because the latch 182 is spring biased, it returns to a generally upright position when catch 176 is disengaged from the finger 178, as shown in FIG. 18. The stop bar 141, shown in FIG. 19, prevents further rotation of the spring biased latch 182 when the stop bar 141 abuts telescoping support arm 140.

The latch 182 is returned behind finger 178 upon directing the telescoping support arm 140, and thus the latch 182 and the catch 176, towards the finger 178 until the catch 176 engages the finger 178, whereupon the catch 176 slides along a leading end 168 of the finger 178 in the direction of arrow B of FIG. 18 until the catch 176 pivots the latch 182, as illustrated in phantom in FIG. 18. With enough rotation of the latch 182 about pivot axle 184, catch 176 moves behind finger 178, at which point the latch 182 returns to normal upright engaged position. Once in this position, the telescoping support arm 140 is supported by the finger 178 and properly positioned in open channel 124 for movement of the tray table 122 between its use and stowed positions.

The locking mechanism 190 further defines the stowed and use positions, but in a more secure fashion. The locking mechanism 190 includes, as shown best in FIGS. 20 and 21, an actuator button 192 including a ramp 194 for disengaging a spring-biased pin 196 from an aperture 198 in telescoping support arm 140. The aperture 198 includes a single opening in larger diameter tube 152 for selective alignment with a pair of openings in smaller diameter tube 150. The openings in smaller diameter tube 150 define the stowed and use positions of the tray table assembly 110. More specifically, because the smaller diameter tube 150 coaxially rotates approximately 90° relative larger diameter tube 152 during movement between the use and stowed positions, as will be explained in detail below, the openings in smaller diameter tube 150 are disposed spaced apart and approximately 90° relative each other.

The pin 196 actuated by button 192 is slidably mounted in a housing 200 and is biased from the housing 200 toward the telescoping support arm 140 by compression spring 202. Further, a post 206 connected to and extending transversely from the pin 196 extends to engage a surface 208 of ramp 194. Thus, when ramp surface 208 moves in the direction of the arrow of FIG. 20 by depressing actuator button 192, the post 206 rides the ramp surface 208 forcing pin 196 upwardly against the bias of spring 202 in housing 200. Upward movement of pin 196 removes the pin 196 from the aperture 198, whereby a smaller diameter tube 150 can slide relative to larger diameter tube 152. With reference to FIG. 16, the locking mechanism 190 is shown in phantom for locking the telescoping support arm 140 in the use position. Depressing actuator button 192 disengages pin 196 from the aperture 198 to permit the user to return the tray table 122 to its stowed position, as shown in FIG. 13.

Figure 22:
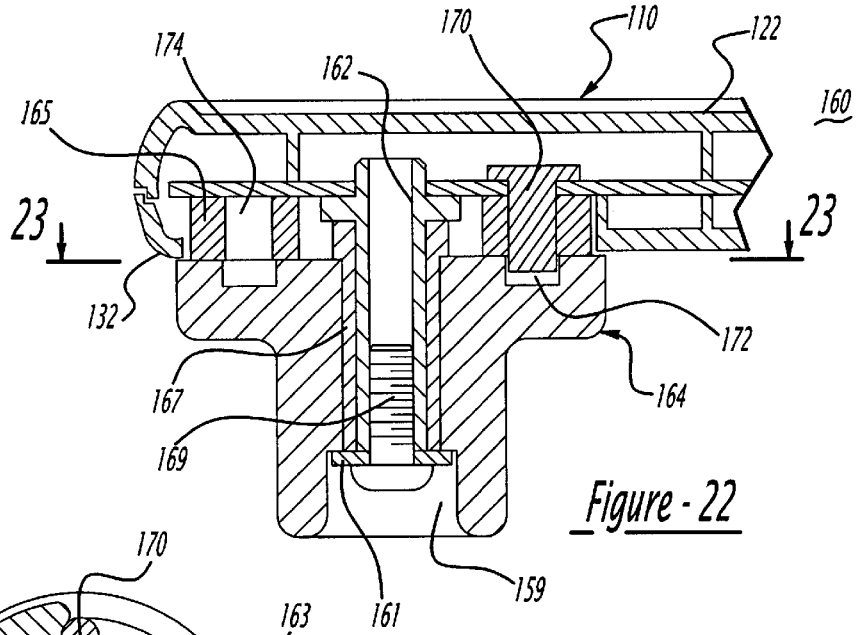
FIG. 22 is a partial side view of a pivot assembly for the tray table of FIGS. 13–16.
Figure 23:
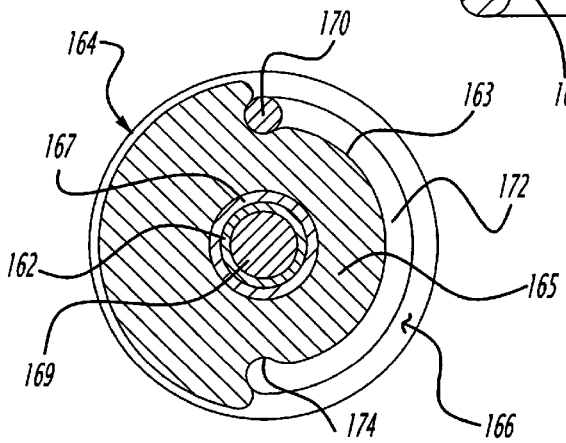
FIG. 23 is a sectional view of the pivot assembly along lines 23—23 of FIG. 22.
Figure 24:
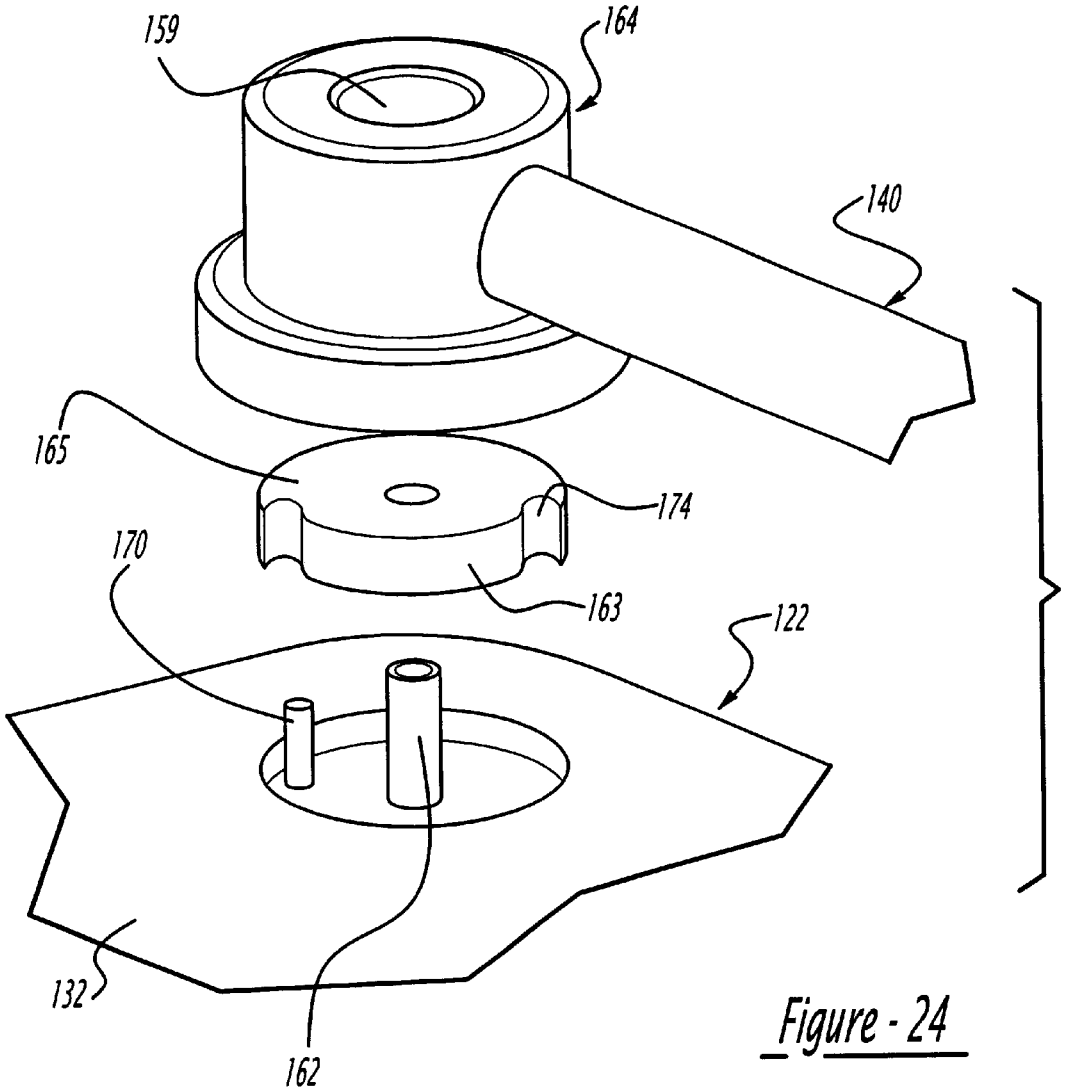
FIG. 24 is an exploded fragmentary perspective view of the pivot assembly of FIG. 22.

As shown in FIGS. 22–24, the pivot assembly 160 allows the tray table 122 to rotate relative telescoping support arm 140 about an axis perpendicular to the telescoping support arm 140. More specifically, the pivot assembly 160 includes a pivot axle 162 fixed to the tray table 122 and journalled for rotation in a bushing 167 of a pivot block 164, which is secured to the moveable end 148 of the telescoping support arm 140. The pivot axle 162, and thus the tray table 122, is secured to the pivot block 164 by a screw 169, which is secured in a threaded coaxial bore through pivot axle 162. A washer 161 joins the screw 169 and pivot axle 162 to the pivot block 164 disposed in an opening 159 of the pivot block 164.

The pivot assembly 160 further includes a locking pin 170 extending transversely downwardly from a bottom surface 132 of the tray table 122 generally parallel to but offset axially from the pivot axle 162. The locking pin 170 slides in an arcuate channel 172 formed in a torque washer 165 and a face 166 of the pivot block 164. The torque washer 165 is a semicircular spacer including an arcuate wall 163 against which the pin 170 slides. The wall 163 is a bearing surface providing torque to the pin 170 as it moves from a first extreme position to a second extreme position defined by the ends of arcuate channel 172 to limit rotation of the tray table 122 relative the telescoping support arm 140. A detent 174 formed in the wall 163 at each end of the arcuate channel 172 further defines these extreme positions, which correspond to the stowed and use positions for tray table 122. Each detent 174 is a slight depression in wall 163 at the end of arcuate channel 172 for registering locking pin 170, which must be rotated with enough force to overcome an edge of the detent 174 to travel in the arcuate channel 172 along wall 163 to the other extreme position. Thus, the detent 174 provide a "locked" feel to the user when placing the tray table 122 in either the use or stowed position. The torque provided by wall 163 provides a "sturdy" feel to the user when rotating the tray table 122 between the use and stowed positions.

To use the tray table assembly 110, a user simply presses actuator button 192 to unlock the tray table 122 from within the open channel 124, whereupon the small diameter tube 150 of telescoping support arm 140 slides from within the large diameter tube 152 of telescoping support arm 140 under force of spring 151. Once telescoping support arm 140 is fully extended, as shown in FIG. 14, the tray table 122 is rotated through pivot assembly 160 along an axis generally transverse to the telescoping support arm 140, as shown in FIG. 15. The tray table 122 is rotated approximately 180° until it is disposed generally upright, at which point it is rotated approximately 90° along an axis coaxial with telescoping support arm 140 by rotating smaller diameter tube 150 within large diameter tube 152 of telescoping support arm 140. This axial rotation places the tray table 122 into its use position, presumably in front of a seat occupant. In this position, aperture 198 through telescoping support arm 140 is again aligned and locking pin 196 registers therein. As shown in FIG. 17, a container holder 220 can be releasably stored in a pocket 222 of the tray table 122 for use by the occupant.

Returning the tray table to its storage position is accomplished by simply reversing the steps above. In summary, the actuator button 192 is pressed to disengage pin 196 from aperture 198 in telescoping support arm 140. Then, the tray table 122 is rotated approximately 90 degrees about the axis of the telescoping support arm 140 by rotating the small diameter tube 150 in the large diameter tube 152 of the telescoping support arm 140. Once fully upright, as shown in FIG. 15, the tray table 122 is rotated approximately 180° about an axis generally perpendicular to telescoping support arm 140 through pivot assembly 160 to place the tray table 122 in the position shown in FIG. 14. Then, the tray table 122 is slid into open channel 124 in armrest 118, against the bias of spring 151, until the tray table 122 locks in its storage position, wherein the pin 196 of locking mechanism 190 again engages aperture 198 in telescoping support arm 140.

The telescoping support arm 140 will typically be made of steel or other metals. Other materials, however, including plastic materials may be used if they provide sufficient strength for the application. The pivot assembly 160 and locking assembly 190 can also be made of a variety of different materials including metals or plastics.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, specification, and following claims.

What is claimed is:

1. A retractable tray table which is mounted on a seat having an armrest, the retractable tray table comprising:

a tray table connected to the armrest by a support arm, said tray table moveable to a first tray position in which said first tray position is parallel to said support arm, and a second tray position in which said second tray position is perpendicular to said support arm, said tray table rotatable about a first axis parallel to said support arm and a second axis perpendicular to said support arm to move said tray table from said first tray position to said second tray position;

said support arm includes a first support arm portion axially slidable relative a second support arm portion, said first support arm portion rotatable relative said second support arm portion to provide rotation about an axis parallel to said support arm;

a pivot assembly mounting said tray table to said support arm for pivoting said tray table from said first tray position to said second tray position, said pivot assembly is mounted on a distal end of said support arm; and a locking mechanism interconnected said support arm to releasably and selectively secure said tray table in said first tray position and said second tray positions, a releasable latch intermediately supporting said support arm, said latch normally engaging a resilient member of said arm rest to support said tray table, said latch releasable from said resilient member upon application of a predetermined force on said tray table, whereby application of a force to said tray table exceeding said determined amount causes latch to disengage from said resilient member to prevent damage to said support arm assembly.

2. The retractable tray table of claim 1, wherein said first portion is telescopically received in said second portion.

3. The retractable tray table of claim 1, wherein said locking mechanism includes a pin selectively registerable in an aperture in said support arm at least partially holding said tray table in said first and second tray positions.

4. The retractable tray table of claim 3, further comprising an actuator button for selectively disengaging said pin from said aperture.

5. The retractable tray table of claim 1, wherein said tray table includes a container holder.

6. The retractable tray table of claim 1, wherein said first support arm portion of said support arm is biased outwardly from said second support arm portion of said support arm by a spring, whereby, upon release of said locking mechanism when said tray table is in said first tray position, said first support arm portion extends axially outward relative said second support arm portion to deploy said tray table to said second tray position.

7. The retractable tray table of claim 1, wherein said pivot assembly includes a pivot axle of said tray table journalled in a pivot block, said pivot block including an arcuate channel on a surface facing said tray table, said arcuate channel receiving a pin of said tray table to define rotational limits of said tray table relative said pivot block.

8. The retractable tray table of claim 7, wherein said arcuate channel of said pivot block provides approximately 180° rotation of said tray table relative said pivot block.

9. The retractable tray table of claim 7, wherein said arcuate channel includes a recess at each of its ends to register said pin.

10. A retractable tray table which is mounted on a seat having an armrest, the retractable tray table comprising:

a tray table connection to the armrest by a support arm, said tray table moveable to a first tray position in which said first tray position is parallel to said support arm, and second tray position in which said second tray position is perpendicular to said support arm, said tray table rotatable about a first axis parallel to said support arm and a second axis perpendicular to said support arm to move said tray table from said first tray position to said second tray position;

a pivot assembly mounting said tray table to said support arm for pivoting said tray table from said first tray position to said second tray position, wherein said pivot assembly includes a pivot axle of said tray table journalled in a pivot block, a pin of said tray table extending parallel to but axially offset from said pivot axle, and a thrust washer disposed between said pivot block and said tray table to at least partially define the rotation of said tray table relative to said pivot block; and a locking mechanism interconnected said support arm to releasably and selectively secure said tray table in said first tray position and said second tray position.

* * * * *